US006582124B2

(12) United States Patent
Mogil

(10) Patent No.: US 6,582,124 B2
(45) **Date of Patent: *Jun. 24, 2003**

(54) INSULATED CONTAINER AND LINER

(75) Inventor: Melvin S. Mogil, Toronto (CA)

(73) Assignee: California Innovations Inc., Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/805,165

(22) Filed: Mar. 14, 2001

(65) Prior Publication Data

US 2001/0010312 A1 Aug. 2, 2001

Related U.S. Application Data

(63) Continuation of application No. 09/199,287, filed on Nov. 25, 1998, now Pat. No. 6,238,091.

(30) Foreign Application Priority Data

Nov. 25, 1998 (CA) ..... 2254687

(51) Int. Cl.[7] ..... B65D 30/02
(52) U.S. Cl. ..... 383/110; 383/111
(58) Field of Search ..... 383/110, 111, 383/2; 220/495.03

(56) References Cited

U.S. PATENT DOCUMENTS

| | | | | |
|---|---|---|---|---|
| 1,826,646 A | | 10/1931 | Blake | |
| 1,985,111 A | | 12/1934 | Shofer et al. | |
| 2,555,788 A | | 6/1951 | Donaldson | |
| 2,610,472 A | | 9/1952 | Maxwell | |
| 2,645,332 A | | 7/1953 | Martin et al. | |
| 2,873,060 A | * | 2/1959 | Inman | 220/495.03 X |
| 2,880,775 A | | 4/1959 | Beattie | |
| 3,255,606 A | | 6/1966 | Bair et al. | |
| 3,572,054 A | | 3/1971 | Curcio | |
| 3,998,072 A | | 12/1976 | Shaw | |
| 4,010,784 A | | 3/1977 | Nattrass et al. | |
| 4,050,264 A | | 9/1977 | Tanaka | |
| 4,091,852 A | | 5/1978 | Jordan et al. | |
| 4,211,091 A | * | 7/1980 | Campbell | 383/110 X |
| 4,286,440 A | | 9/1981 | Taylor | |
| 4,499,998 A | | 2/1985 | Carlson | |
| 4,499,999 A | * | 2/1985 | Behar | 206/546 |
| 4,509,645 A | | 4/1985 | Hotta | |
| 4,521,911 A | | 6/1985 | Vance | |
| 4,551,988 A | | 11/1985 | Petrantoni | |
| 4,610,286 A | | 9/1986 | Cyr | |
| 4,655,052 A | | 4/1987 | Garcia | |
| 4,673,117 A | | 6/1987 | Calton | |
| 4,679,242 A | * | 7/1987 | Brockhaus | 383/110 X |

(List continued on next page.)

FOREIGN PATENT DOCUMENTS

| | | |
|---|---|---|
| CA | 2149491 | 5/1995 |
| GB | 2 025 593 A | 1/1980 |

*Primary Examiner*—Jes F. Pascua
(74) *Attorney, Agent, or Firm*—Arent Fox Kinter Plotkin & Kahn, PLLC

(57) ABSTRACT

A portable soft sided insulated container has an impermeable liner that provides a liquid holding barrier. The liner is folded from a single monolithic plastic sheet to reduce or eliminate the need for heat welded seams. The liner seats within the container and has a releasable attachment around its lip for mating with the rim of the container. The container has an insulated lid so that the entire assembly may be closed. The liner can be removed for cleaning, or replacement if punctured. When not in use the entire assembly can be folded into a collapsed position for storage.

54 Claims, 12 Drawing Sheets

U.S. PATENT DOCUMENTS

| | | | | |
|---|---|---|---|---|
| 4,706,856 | A | | 11/1987 | Jacober |
| 4,819,793 | A | | 4/1989 | Willard et al. |
| 4,858,444 | A | | 8/1989 | Scott |
| 4,916,923 | A | | 4/1990 | Adams et al. |
| 4,923,060 | A | | 5/1990 | Breslau |
| 4,929,094 | A | | 5/1990 | Becker ..... 383/110 X |
| 4,941,603 | A | | 7/1990 | Creamer et al. |
| 4,974,966 | A | | 12/1990 | Fabbi |
| 4,984,662 | A | | 1/1991 | Jacober |
| 5,050,399 | A | | 9/1991 | Peahl |
| 5,095,718 | A | | 3/1992 | Ormond et al. |
| D328,550 | S | | 8/1992 | Mogil et al. |
| 5,149,203 | A | | 9/1992 | Sacks ..... 383/111 |
| 5,313,807 | A | | 5/1994 | Owen |
| 5,328,265 | A | | 7/1994 | Clooney |
| 5,354,131 | A | | 10/1994 | Mogil |
| 5,400,610 | A | | 3/1995 | Macedo |
| 5,472,279 | A | | 12/1995 | Lin ..... 383/2 |
| 5,490,396 | A | * | 2/1996 | Morris ..... 383/110 X |
| 5,501,338 | A | | 3/1996 | Preston |
| 5,505,307 | A | | 4/1996 | Shink |
| 5,562,228 | A | | 10/1996 | Ericson |
| D382,771 | S | | 8/1997 | Mogil |
| D382,772 | S | | 8/1997 | Mogil |
| D387,249 | S | | 12/1997 | Mogil |
| D389,704 | S | | 1/1998 | Yousko et al. |
| 5,718,124 | A | | 2/1998 | Senecal |
| 5,820,268 | A | | 10/1998 | Becker et al. |
| 5,842,571 | A | | 12/1998 | Rausch |
| 5,857,778 | A | * | 1/1999 | Ells ..... 383/110 X |
| 5,904,230 | A | * | 5/1999 | Peterson ..... 190/107 |
| 6,234,677 | B1 | * | 5/2001 | Mogil ..... 383/110 |
| 6,238,091 | B1 | * | 5/2001 | Mogil ..... 383/110 |
| 6,247,328 | B1 | * | 6/2001 | Mogil ..... 383/110 X |

* cited by examiner

INSULATED CONTAINER AND LINER

This application is a continuation of U.S. patent application Ser. No. 09/199,287 filed Nov. 25. 1998 and issued to U.S. patent No. 6,238,091 on May 29, 2001.

BACKGROUND OF THE INVENTION

Field of the Invention

This invention relates to the field of soft sided insulated containers. In particular it relates to soft sided insulated containers having removable impermeable liners for discouraging or preventing the leakage of liquids.

In recent times soft sided insulated containers have become popular for carrying either articles that may best be served cool, such as beverages or salads, or warm, such as appetizers, hot dogs, and so on. Such containers are frequently used to carry liquids, whether hot liquids, such as soup containers, coffee or tea, or cold liquids such as beer pop, juices and milk. The containers are typically made in a generally cube like shape, whether of sides of equal length or not, having a base, four upstanding walls, and a top. The top is generally a lid which opens to permit articles to be placed in, or retrieved from, the container.

By the nature of their use, it is advantageous for the containers to be water tight. That is, whether to hold melted run-off from ice cubes or to hold spilled liquids, the container must be sufficiently liquid tight that it does not leave a trail of drips, or become moist or sticky to the touch of a person carrying the container.

The present inventor has found it disadvantageous to try to seal the container itself. The type of insulating wall used by the present inventor is generally sewn at its seams. Sewn seams have a tendency to leak at the stitches. Another approach is to fold the insulated blanket from which the container is made, to present an assembly that, through folding, has no seams. This is also disadvantageous, in the present inventor's view, because the insulated blanket used to form the container walls is relatively thick. The thick material does not fold well, in the inventor's view. It would be preferable to form an impermeable layer that has a relatively thin wall thickness so that the resulting product does not look bulky and cumbersome.

It is also advantageous to be able to clean the inside of the insulated container. Spilt liquids may not always have the most attractive air when allowed to dry, and may cause the inside of the container to become unsightly. It is possible to provide a plastic liner for soft sided insulated containers. A see through plastic liner can be made of the minimum amount of material by using only a single layer, and forming seams where the edges of the material meet. A common method of forming such a seam is to weld two adjacent edges together by heating. However, an existing liner of this type is known to have had a tendency for the heat welded seams to develop leaks over time. It would be advantageous to reduce or eliminate the number of heat welded seams formed in areas of the liner that may need to be water tight.

In general, manufacture of an assembly of this type emphasizes cost reduction. One common source of cost savings is a reduction of the raw material used. However, the present inventor has observed, counter-intuitively, that the overall benefit an increase in raw material use can outweigh the cost saving that would otherwise be achieved. Unexpectedly, the use of a greater amount of material in a folded assembly has been found to be advantageous, and has eliminated the need to have a heat welding station in manufacture.

SUMMARY OF THE INVENTION

In an aspect of the invention there is a soft-sided insulated container, and a removable liner for placement inside the container. The liner is folded from a monolithic sheet of liner stock to define a chamber, capable of holding liquids. The liner is free of heat welded seams.

In another feature of that aspect of the invention the liner is made from a water impermeable plastic sheet. In an additional feature of that aspect of the invention the liner is made from a translucent static cling vinyl sheet. In another additional feature of that aspect of the invention the soft sided insulated container has a base, sides and a top. The liner has a base, sides for placement inside and adjacent to the base and sides of the container. The top of the container is moveable to an open position to permit articles to be placed in the chamber.

In still another additional feature of that aspect of the invention the chamber has an opening, the opening having a lip, and the liner is mated to the cooler about the lip. In yet another additional feature of that aspect of the invention the opening has four sides, the lip extends about the four sides opening and the liner is mated to the container on the four sides. In a further additional feature of that aspect of the invention the liner has a rectangular base and four sides extending from the base, each of the sides having an edge adjoining the base and a distal edge distant from the base. The chamber has an opening defined between the distal edges of the sides.

In a still further additional feature of that aspect of the invention one of the sides has a lid member extending therefrom, the lid member being moveable to close the opening of the liner. In yet another additional feature of that aspect of the invention the lid member is a flap formed integrally with the liner, the flap having four lid edges, one edge being a folded hinge edge adjoining one of the distal edges of the sides, the remaining three lid edges having a closure for mating with the remaining three distal edges.

In another aspect of the invention there is a removable liner for placement inside the container. The liner is formed from a water impermeable plastic sheet. The sheet has a periphery. The liner has a quadrilateral base and four sides extending from the base to define a chamber therebetween capable of holding water. Each of the sides are joined to the base at a base edge. Each of the sides has a pair of lateral edges each meeting the base edge at a corner. Each of the sides has an edge opposed to the base edge and meets each of the lateral edges at a corner. The sheet has corner portions defined between adjacent lateral edges of two of the sides and the periphery and the corner positions are folded to lie against the sides.

In a further additional feature of that aspect of the invention the base is a rectangle and two of the sides, joined to the base on opposite sides of the rectangle, are trapezoidal. In a still further additional feature of that aspect of the invention the chamber has the shape of an inverted, truncated rectangular based pyramid. In yet another additional feature of that aspect of the invention the container has an internal face made from a reflective material and the liner is transparent.

In another aspect of the invention there is a soft sided insulated container, and a removable liner for placement inside the container. The liner is formed from a water impermeable plastic sheet. The sheet has a periphery. The liner has a rectangular base and four sides extending from the base to form a chamber therebetween, each of the sides being joined to the base at a base edge. The sheet is folded on a first pair of parallel fold lines to define one pair of the base edges. The sheet is folded on a second pair of fold lines to define the remainder of the edges. The sheet has four corner portions each defined between an end portion of one of the first pair of fold lines, an adjacent end portion of one of the second pair of fold lines and the periphery, and the corner portions are folded to lie against the sides.

In an additional feature of that aspect of the invention the sides have an inside face and an outside face and the corner portions are folded to lie against the outside faces. In another additional feature of that aspect of the invention each of the corner is folded to form a triangular flap, and each of the flaps is folded to lie against one of the sides. In still another additional feature of that aspect of the invention one of the triangular flaps is folded to lie against each of the sides of the liner. In still yet another additional feature of that aspect of the invention two of the triangular flaps are folded to lie against one side of the liner. In a further additional feature of that aspect of the invention two of the triangular flaps are folded to lie against one side of the liner, and the other two triangular flaps are folded to lie against another side of the liner.

In still a further additional feature of that aspect of the invention each of the sides has a distal edge opposed to its respective base edge. The chamber has a lip defined by the distal edges. The corner portions are fastened to the sides adjacent the lip. In still yet a further additional feature of that aspect of the invention one of the sides has a cover flap formed integrally therewith, and joined thereto at a cover fold, the cover flap mating with the distal edges of the remaining sides of the liner. In an additional feature of that aspect of the invention the container has a reflective inner surface and the liner is transparent.

DESCRIPTION OF THE DRAWINGS

These aspects and other features of the invention can be understood with the aid of the following illustrations of a number of exemplary, and non-limiting, embodiments of the principles of the invention in which.

DETAILED DESCRIPTION OF THE PREFERRED EMBODIMENTS

Figure 1:
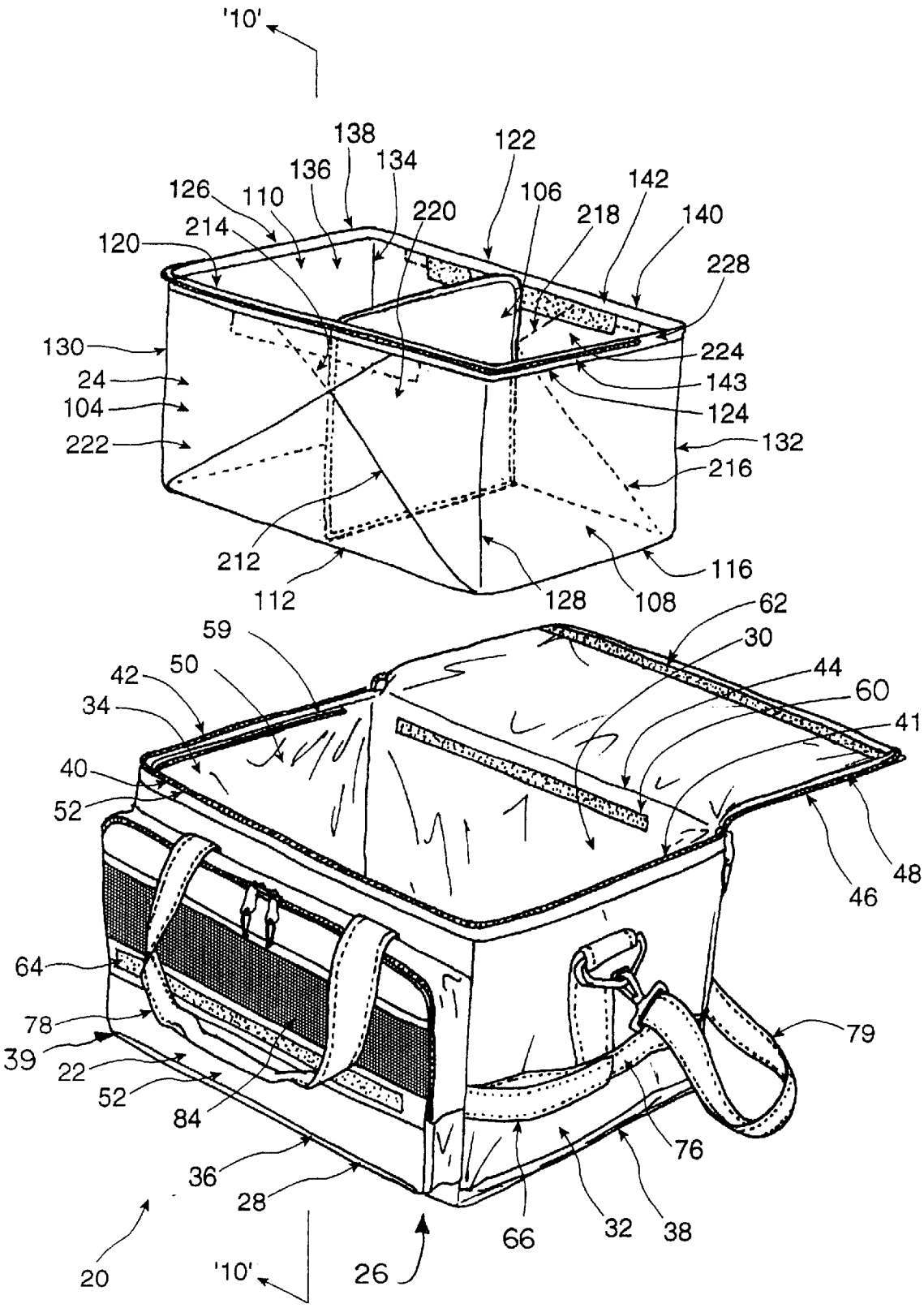
FIG. 1 is a three quarter view, general arrangement drawing of an insulated container and liner assembly according to the present invention.

The description which follows, and the embodiments described therein, are provided by way of illustration of an example of a particular embodiment, or examples of particular embodiments, of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention.

Figure 2:
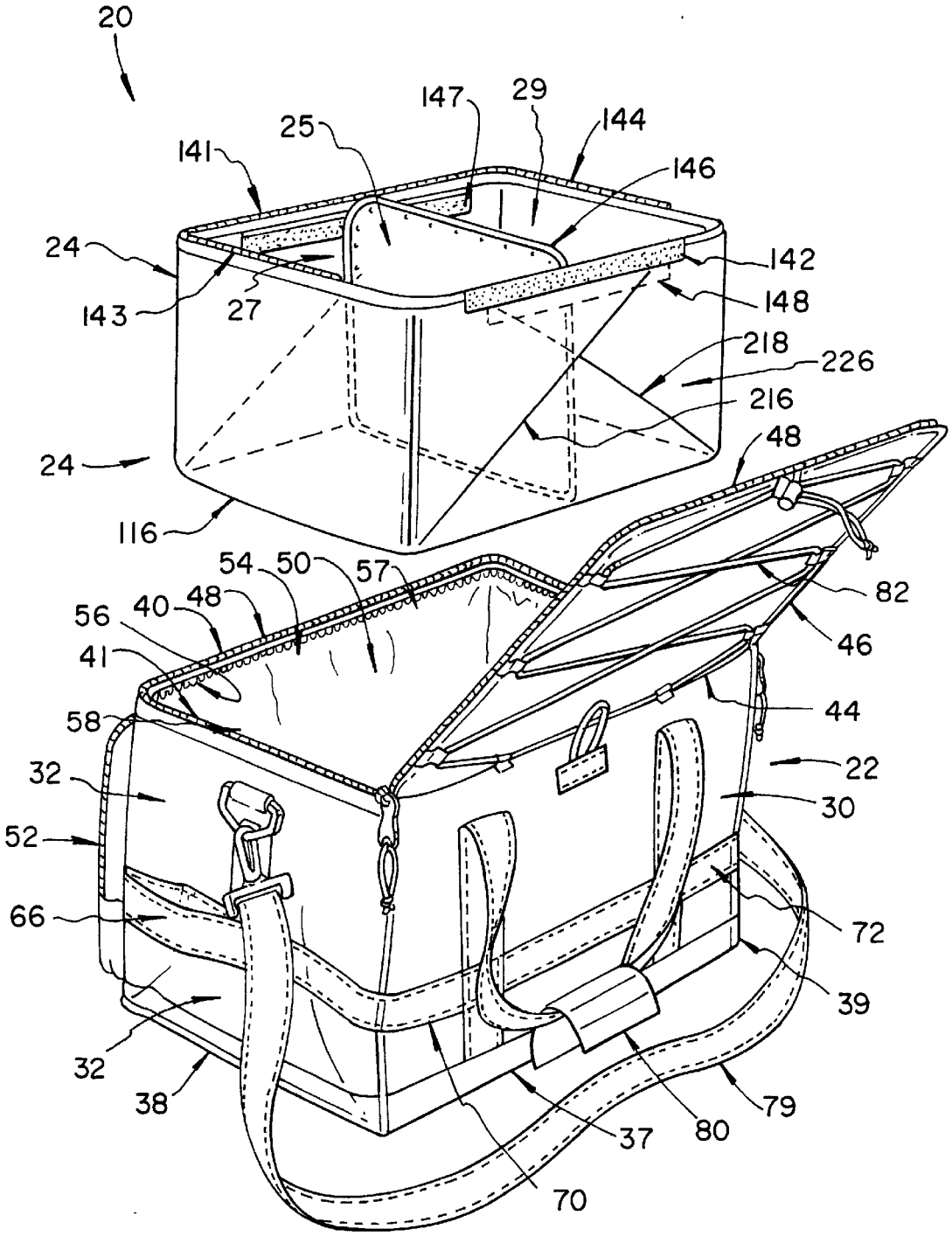
FIG. 2 is a view of the liner of FIG. 1 taken on an opposite angle.

Referring to the general arrangement illustrations of FIGS. 1 and 2, an example of a preferred embodiment of an insulated container and liner assembly according to the principles of the present invention is indicated generally as 20. It has two major elements, those being an outer casing in the nature of a soft-sided insulated container 22, and a removable, impermeable liner 24 for placement inside container 22. An optional moveable bulkhead, or baffle, in the nature of a partition wall 25 seats within liner 24 for dividing the interior space into two sub-compartments 27 and 29.

Looking at these major elements in detail, it can be seen that container 22 has a bottom 26, a front panel 28, a rear panel 30, and a pair of left and right hand side panels 32 and 34. In this preferred embodiment the choice of front and rear, left and right, orientations is arbitrary. Each of front panel 28, rear panel 30, and left and right hand side panels 32 and 34 is joined at sewn seams to bottom 26 at bottom vertices 36, 37, 38, or 39 respectively. Similarly, front panel 28 and side panels 32 and 34 have top edges 40, 41 and 42, distant from their base edges. Rear panel 30 is joined by a folded hinge 44 at its top edge to a top panel in the nature of a lid 46. Lid 46 has a closure member in the nature of a zipper 48 extending in a U-shape around the three free edge portions of its periphery to mate with the other portions of zipper 48 positioned about the three top edges 40, 41 and 42 of panels 28, 32 and 34. Lid 46 is moveable between a closed position, in which zipper 48 may be zipped closed, and an open position in which lid 46 is folded back to permit entry and exit of objects to and from an internal cavity 50 defined between bottom 26 and panels 28, 30, 32 and 34. A generally rectangular insulated auxiliary pouch 52 is mounted to the front face of front panel 28.

In the preferred embodiment, lid 46 has an extent substantially equal to that of bottom panel 26. This need not be the case. Lid 26 could be a small opening set in a larger top panel, or could be an opening of half, or some other portion of the panel. The opening need not extend fully along three sides of lid 26, but could extend along part of one or two sides as may be found suitable in a particular use.

Top edges 40, 41, and 42 form the rim 54 of cavity 50. On the inside of rim 54 is a liner securing means, or liner attachment mounting, in the nature of a zipper 56, which, in the embodiment illustrated, includes portions 57, 58, and 59 mounted respectively to panels 28, 32, and 34 near their upper margins, and a hook and eye fabric fastener strip 60 mounted to panel 30. Although this arrangement is preferred, in an alternative embodiment all of strip portions 57, 58, 59 and 60 (or some other combination of them) could be hook-and-eye fabric fasteners. Other types of mounting could be used, in addition to zippers, such as interlocking seal strips, snaps, clips, grommets or other means.

Figure 7:
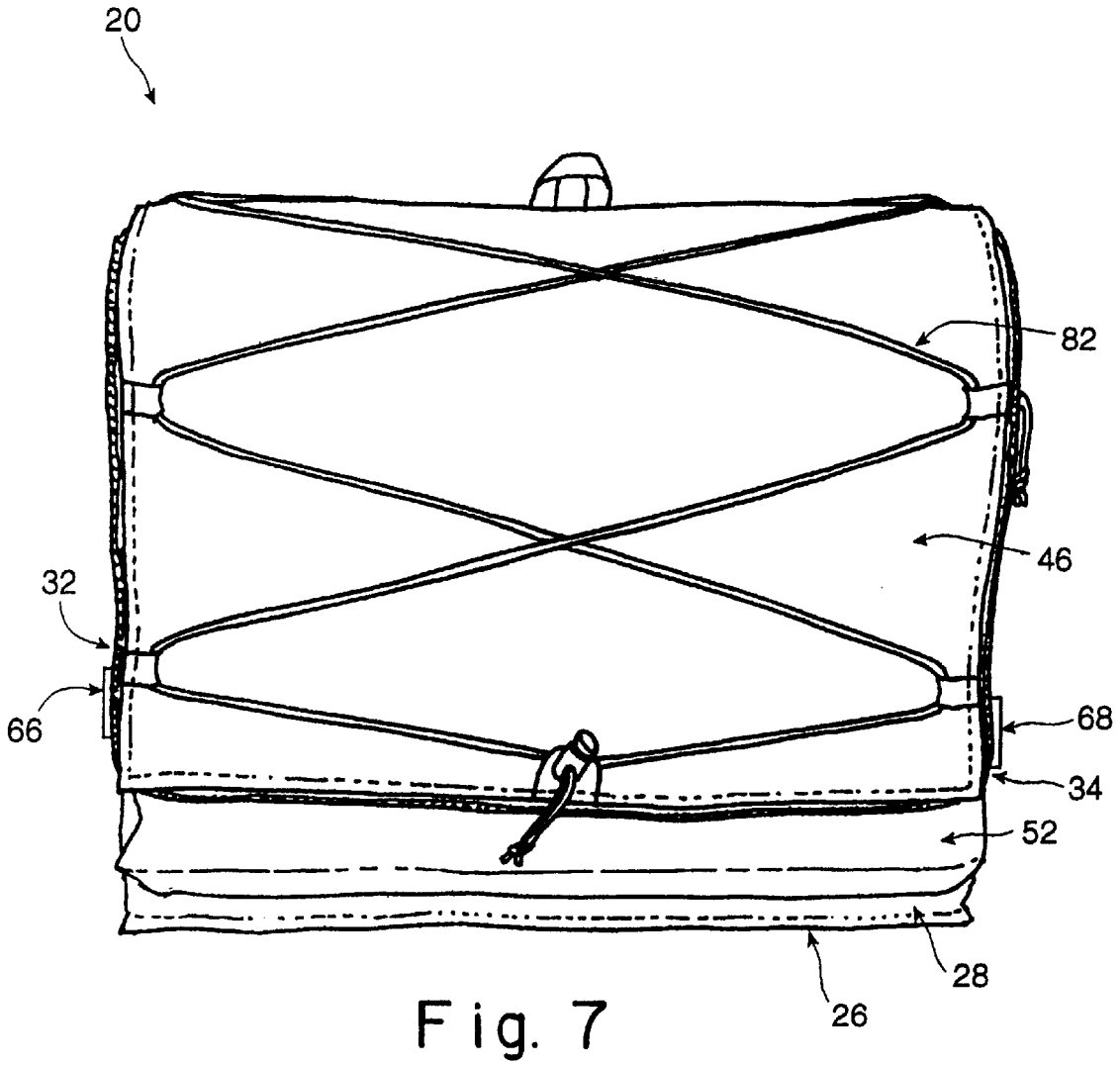
FIG. 7 is a front view of the assembly of FIG. 1 in a collapsed position.
Figure 8:
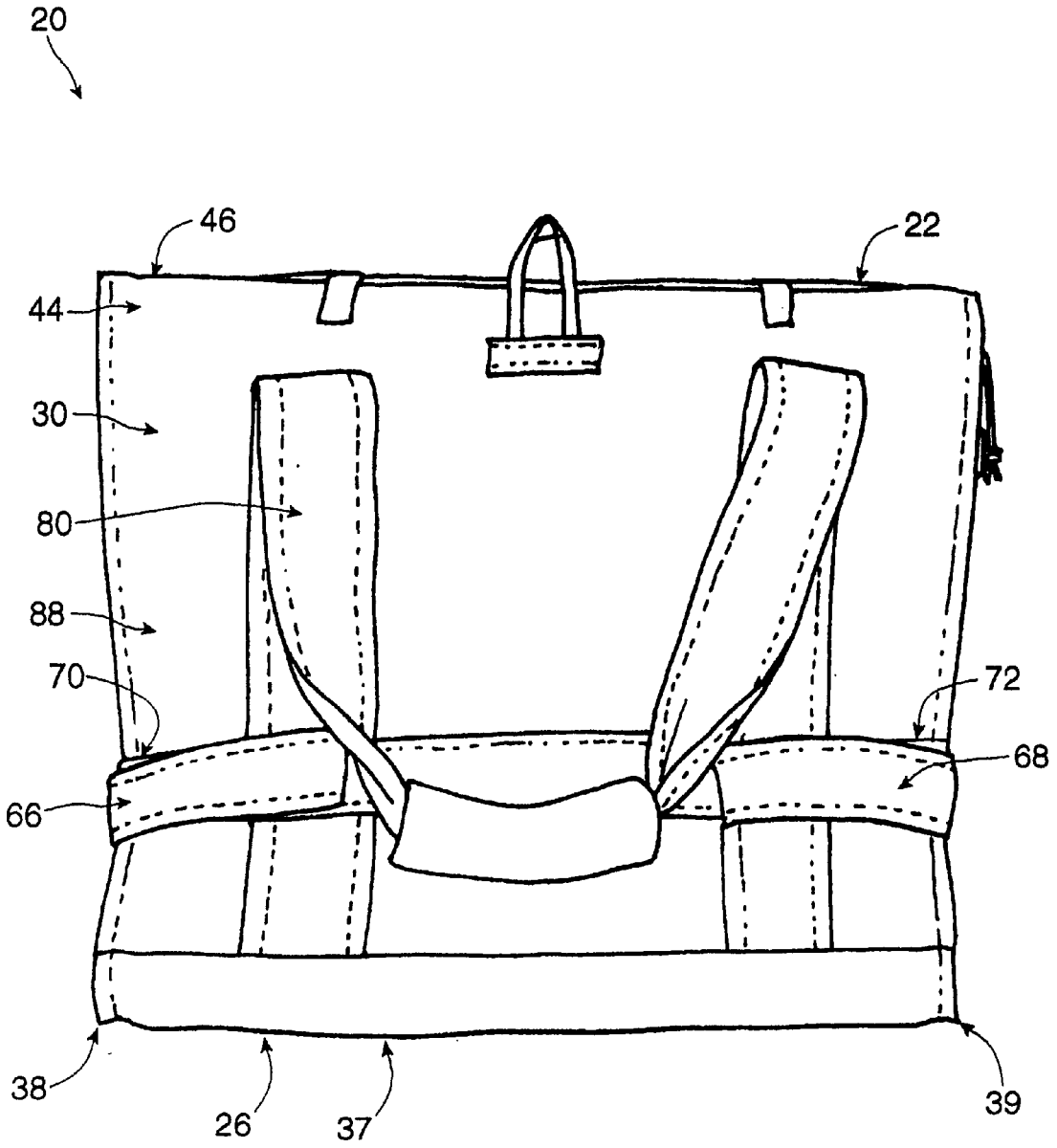
FIG. 8 is a rear view of the assembly of FIG. 1 in a collapsed position.
Figure 9:
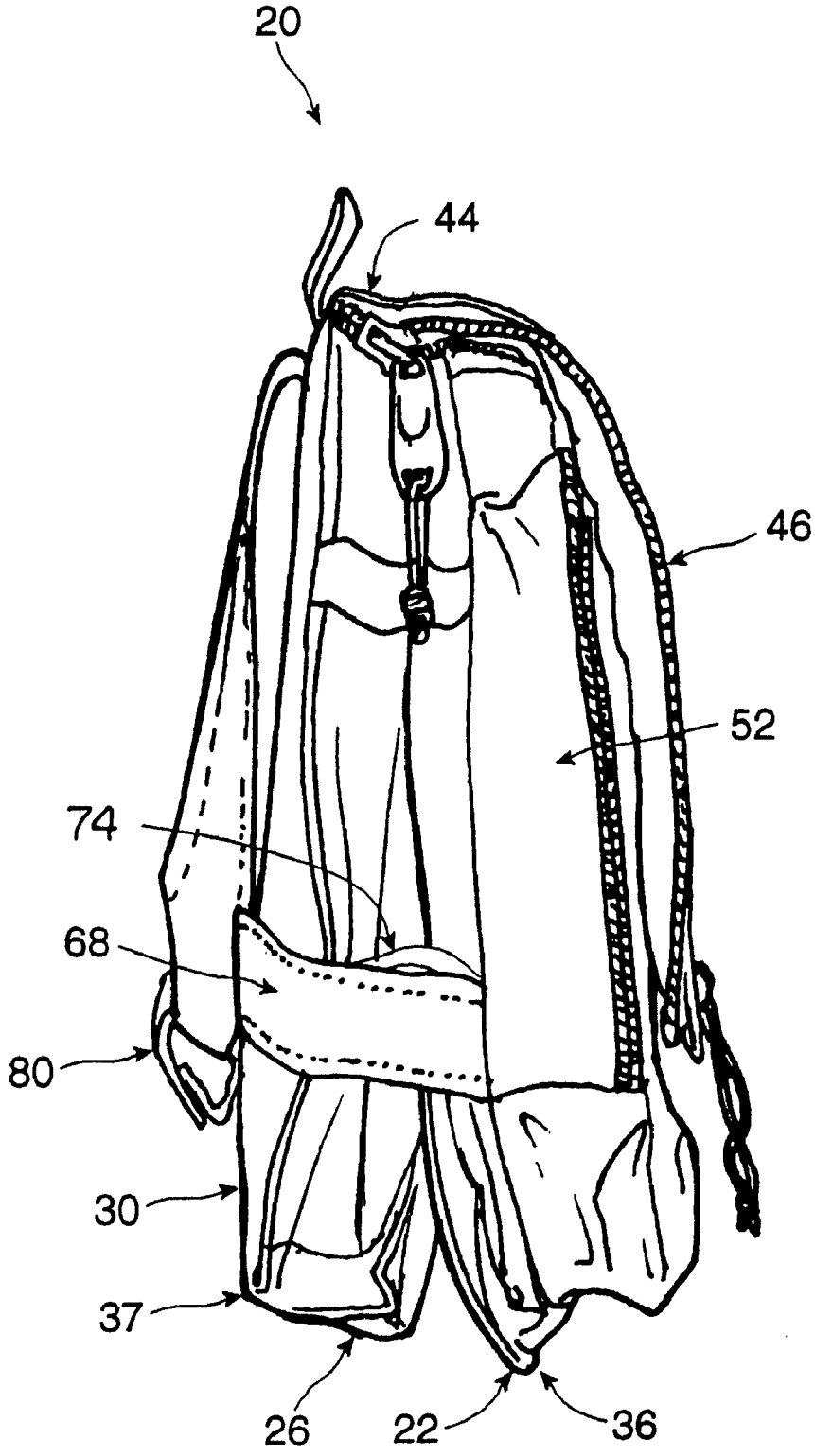
FIG. 9 is a side view of the assembly of FIG. 1 in a collapsed position.

Container 22, with liner 24 installed, can be folded to a collapsed position, as shown in FIGS. 7, 8 and 9. In this collapsed, or storage position, side panels 32 and 34 fold inward, and bottom 26 folds upward. This permits front panel 28 to move toward rear panel 30. Lid 46 is then drawn forward and downward in front of front panel 28 and auxiliary pouch 52. Lid 46 has, on its inner face, spaced inwardly from zipper 48, a retainer in the nature of another hook and eye fastener strip 62 that engages a mating hook and eye fastener strip 64 as best seen in FIG. 1_located on a lower portion of the front face of auxiliary pouch 52. In addition, left and right hand side retainers 66 and 68 mounted to the left and right hand edges of auxiliary pouch 52 of front panel 28 are drawn around to fasten to fastening strips 70 and 72 located on the outer, rearward face of rear panel 30. (When container 22 is in its open position, side retainers 66 and 68 engage storage strips 74 and 76 located on side panels 32 and 34 respectively).

Other features of container 22 are visible in FIGS. 1 and 2. Front and rear carrying handles 78 and 80 with reinforced bails are attached to both front panel 28 and rear panel 30 to permit two people to carry assembly 20 between them. In the preferred embodiment assembly 20 has a maximum capacity of 24 quarts. Smaller embodiments, include a twelve quart container. A single shoulder strap 79 is attached to side panels 32 and 34. An elasticized retaining matrix 82 permits other materials, such as cups, plates, serving utensils or other objects to be carried on top of assembly 20. Above strip 64, auxiliary pouch 52 has a see-through mesh pocket 84, such as may be convenient for carrying knives, forks, spoons or other objects.

Figure 10:
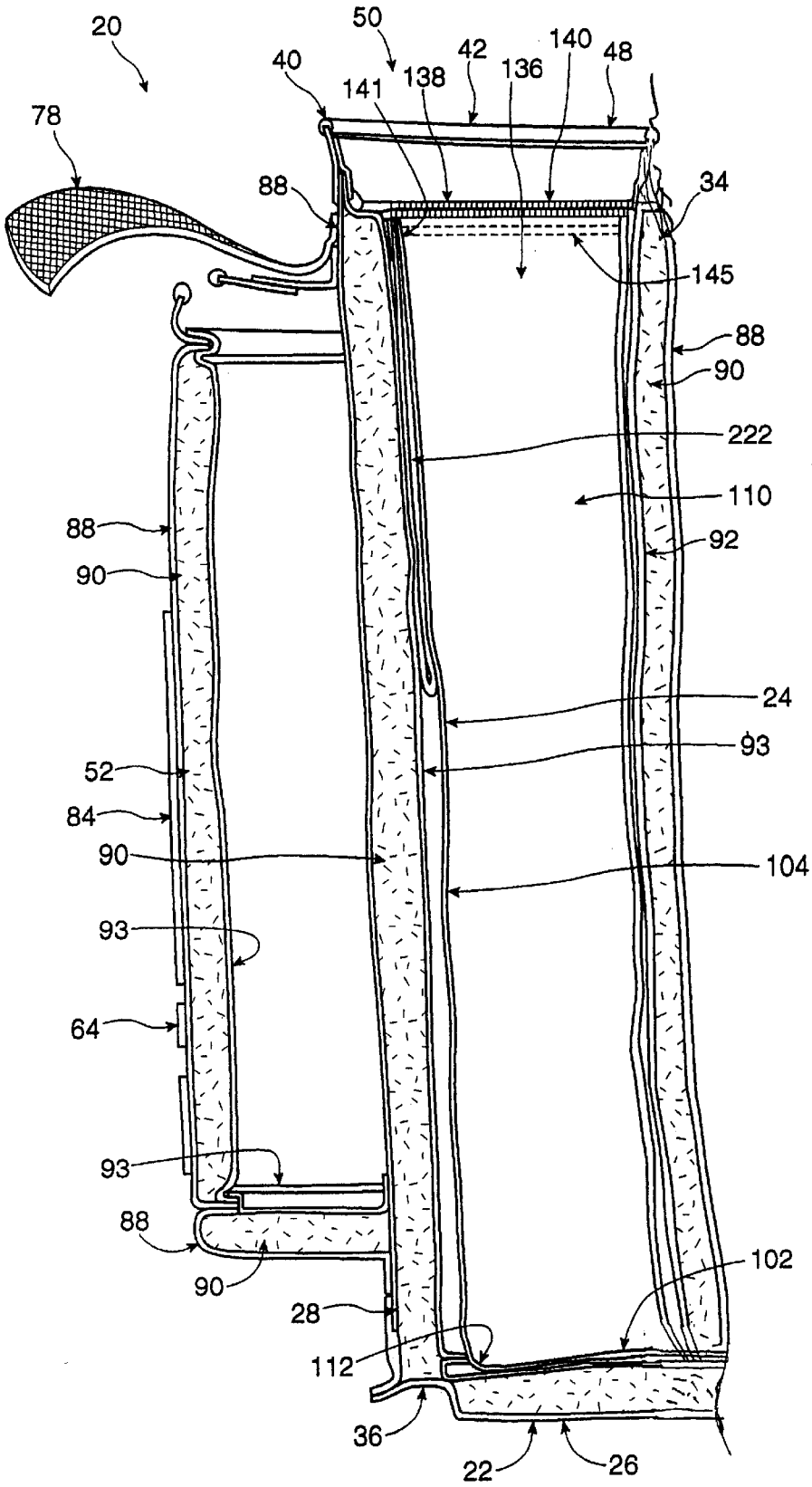
FIG. 10 is a section showing the wall construction of the assembly of FIG. 1.

FIG. 10 shows a cross section of front panel 28 with liner 24 in place. A scab section of panel 34 is also shown to reveal its layers of construction. With the exception of auxiliary pouch 52, this section is typical not only of front panel 28 but also, generally, of rear panel 30, side panels 32 and 34, bottom 26 and lid 46. The outer facing layer of front panel 28 is a canvas covering layer 88 for resisting abrasion. It overlays a closed cell foam insulation layer 90. The inner face of insulation layer 90 is covered by flexible plasticised metallic foil sheeting 92 that is shiny and reflective. The material is sold under the name Therma-Flect (T.M.). Liner 24 lies inside sheeting 92, and is pressed against it by the objects it contains. The inside of pouch 52 is lined with white vinyl sheeting, 93 on its forward and bottom sides.

Figure 3:
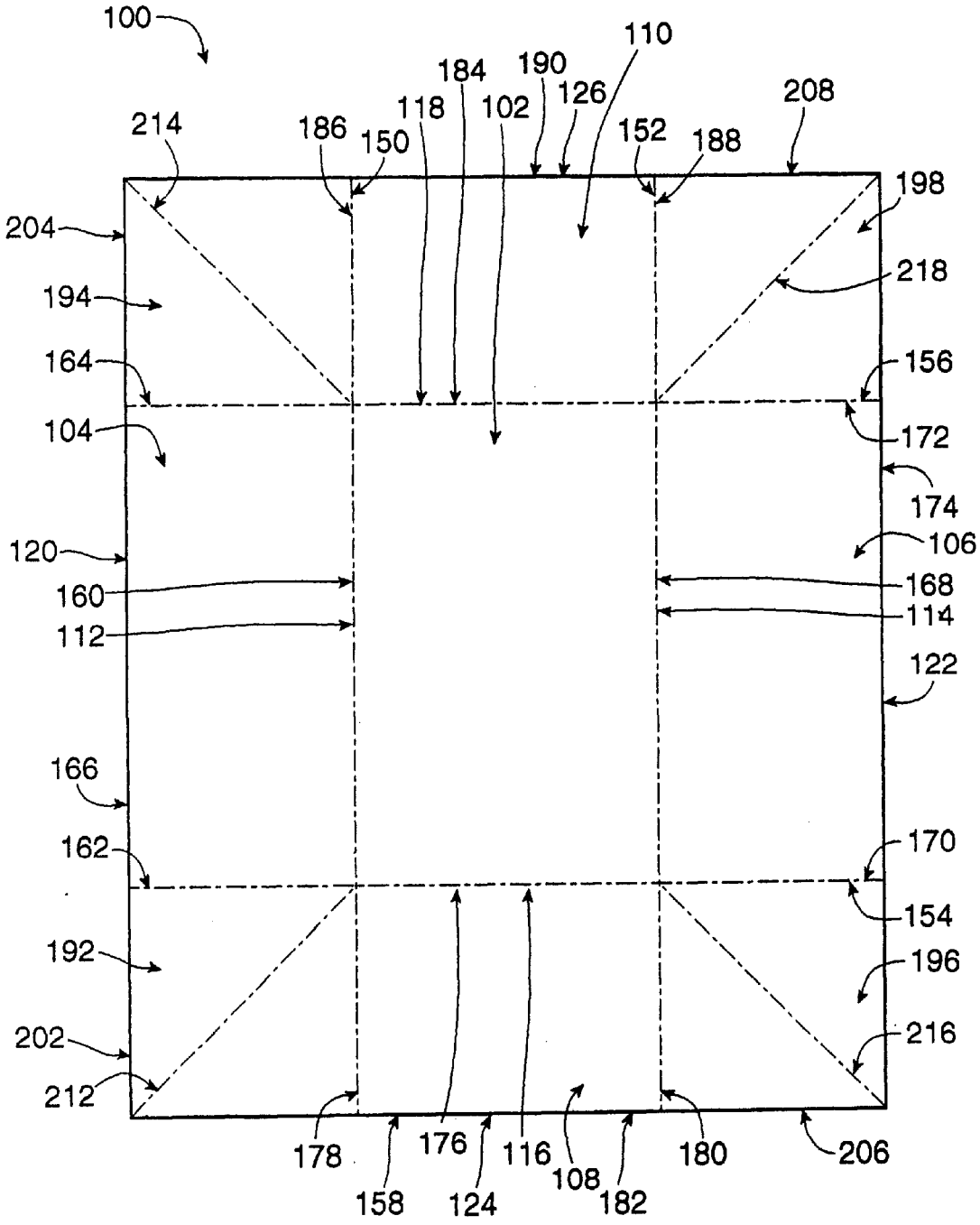
FIG. 3 is a developed view of a liner for use in the assembly of FIG. 1.

Liner 24 is shown in FIGS. 1, 2 and 3. It is made from a membrane, or web, in the nature of a sheet 100 of flexible, transparent plastic stock, in particular, static cling vinyl. The shiny, reflective surface of sheeting 92 is visible through liner 24 in use. Liner 24 has a base 102 and four sides, front, rear, left hand and right hand respectively, 104, 106, 108, and 110 extending upwardly from base 102. Each of sides 104, 106, 108 and 110 is joined to base 102 at a base edge, 112, 114, 116 or 118, as indicated, and each has an opposite, distal edge 120, 122, 124 or 126 distant from its respective base edge. The sides meet at respective upstanding corners 128, 130, 132 and 134. A chamber 136 is defined between base 102 and sides 104, 106, 108 and 110. Chamber 136 has an opening 138 defined by the peripheral lip 140 formed collectively by the distal edges 120, 122, 124 and 126 of sides 104, 106, 108 and 110. Immediately below lip 140 liner support fasteners, in the nature of hook and eye strips, are mounted to sheet 100. This mounting may be by heat welding or by use of a bonding agent or adhesive. In the preferred embodiment lip 140 is folded over to form a hem, and fasteners 141, 144, 143 are of the nature of a continuous zipper around three sides of lip 140, and a fastener 142 in the nature of a fabric hook-and-eye strip are sewn in place with stitching 145 that is at a height relative to base 102 that is expected to be well above the liquid level in liner 24.

In an alternate embodiment, fasteners 141, 142, and 143 are all fabric hook and eye fasteners each mounted on one side of lip 140, and which mate with corresponding hook-and-eye fastener strips mounted to container 22. These fastener strips are commonly sold under the name Velcro (T.M.). Optional partition 25 is variably positionable. About the upper portion of its periphery it has a strip engaging material 146 that catches on mating strips 147 and 148 located on the inner face of liner 24. These strips can be hook and eye fastener strips. The range of the strips permits the division of sub compartments 27 and 29 of chamber 136 into equal, half-and half portions, or into some other portions, such as ¼ to ¾, ⅔ to ⅔, ⅖ to ⅗ and so forth as may be found desirable given the objects to be contained in chamber 136.

In FIG. 3 sheet 100 is shown in developed view, as it would be before being folded to form liner 24. A first pair of parallel fold lines 150 and 152 extend across sheet 100, and a second pair of parallel fold lines 154 and 156, perpendicular to lines 150 and 152 extend along sheet 100, thus dividing it into nine portions within the rectangular periphery, 158, of sheet 100. It will also be noted that each of lines 150, 152, 154 and 156 has two intersections, and is thus divided into a central sector between the parallel lines it intersects, and a pair of end sectors between each of the parallel lines it intersects and the line's termination at periphery 158.

The central portion of sheet 100, bounded by the central sector of each of lines 150, 152, 154 and 156, defines base 102, each of those sectors defining one of base edges 112, 114, 116 and 118. Front side 104 is defined between the central sector 160 of line 150, two parallel forward end sectors 162 and 164 of lines 154 and 156, and a mid-edge sector 166 of periphery 158. Rear side 106 is defined by the central sector 168 of line 152, two parallel rearward end sectors 170 and 172 of lines 154 and 156, and a mid edge sector 174 of periphery 158. Left hand side 108 is defined by central sector 176 of line 154, two left end sectors 178 and 180 of lines 150 and 152, and a mid-edge sector 182 of periphery 158. Right hand side 110 is defined by central sector 184 of line 156, two right end sectors 186 and 188 of lines 150 and 152, and a mid-edge sector 190 of periphery 158.

The remaining four portions of sheet 100 are corner portions 192, 194, 196 and 198 defined by a pair of adjacent end sectors of a pair of perpendicular lines, and a corner sector of periphery 158, indicated respectively as 202, 204, 206 and 208. Corner portions 192, 194, 196 and 198 are bisected by diagonal bisectors 212, 214, 216 and 218 which extend from the intersection of the respective perpendicular lines to periphery 158.

Having thus defined the geometry of sheet 100, liner 24 is formed by folding sides 104, 106, 108 and 110 upwardly such that sectors 162 and 178, 164 and 188, 170 and 180, and 172 and 186 lie adjacent to each other to form corner 128, 130, 132 and 134 respectively. This folding necessitates folding of corner portions 192, 194, 196 and 198, and this is done along their respective diagonal bisectors.

When folded along bisectors 212, 214, 216 and 218 corner portions 192, 194, 196 and 198 form triangular flaps 220, 222, 224 and 226 as best seen in FIGS. 1 and 2. In the preferred embodiment flaps 220 and 222 are folded to lie against the outside face of front side 104, the corner of flap 220 lying most distant from corner 128 overlapping the corner of flap 222 lying most distant from corner 130. Similarly flaps 224 and 226 are folded to lie against the outside face of rear side 106 the most distant corner of flap 224 overlapping the most distant corner of flap 226. One edge of each flap lies roughly flush with lip 140, which is folded over and the entire periphery of opening 138 of chamber 136 sewn as a hem 228 having a double row of stitches. In this way liner 24 is formed from sheet 100 such that it is not only free of welded seams, but free of any seams below hem 228 of lip 140.

In the preferred embodiment the folding process is purely mechanical, and can be performed relatively quickly, in contradistinction to heat welding or adhesive bonding processes which requires a time interval for heating and cooling or for adhesive curing. In as much as the preferred embodiment uses a relatively thick static cling vinyl, sheet 100 can be folded over a cube form of the desired dimensions, and held in place by its own clinging properties in preparation for the sewing of hem 228. The overlap of the tips of flaps 222 and 224, and flaps 226 and 228, and subsequent sewing makes it doubly improbable that liner 24 will unfold.

Liner 24 is formed from a single integral sheet, and, absent punctures of that sheet is not intended to leak below the level of the sewn seam at lip 140. The body of base 102 and sides 104, 106, 108 and 110 is seamless, being free of heat welds or other joints. In general use the liquid level in chamber 136 is not expected to be greater than one half of the height of the sides, and still less commonly to be more than three quarters of the height. There are no seams below either of these levels, heat welded or otherwise.

Liner 24 is also thin enough that it can be folded inside container 22 when container 22 is compressed to its collapsed position as illustrated in FIGS. 7, 8, and 9. Liner 24 need not be transparent, but could be translucent or opaque. A transparent liner is preferred since it permits the reflection of sheeting 92 to be seen.

Figure 11A:
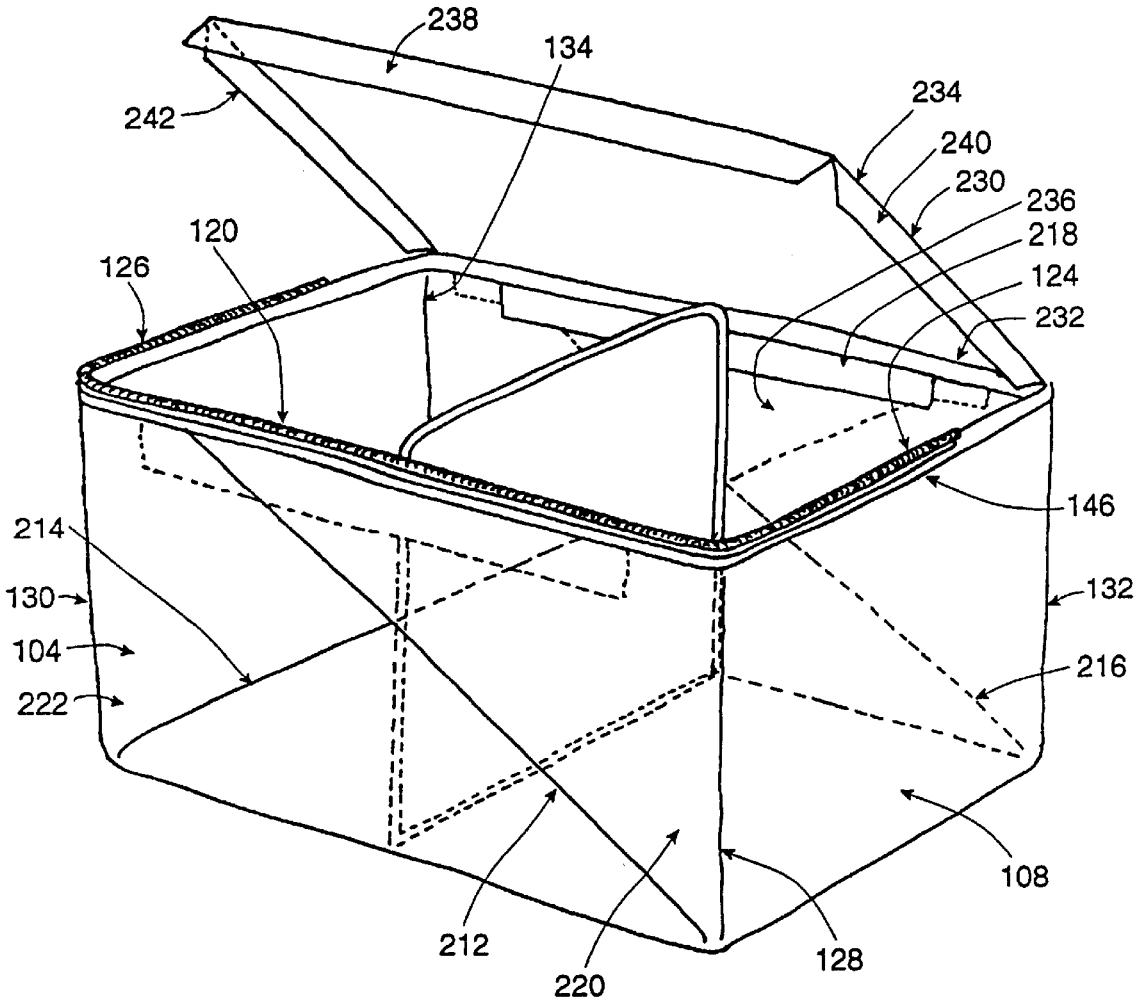
FIG. 11*a* is a view of an alternative liner for the assembly of FIG. 1.

In an optional embodiment, a liner 224 can have its own closure, or lid, 230, to provide a double closure with lid 46 of container 22 in FIG. 11*a*. As shown in FIG. 11*a*, optional lid 230 extends on a folding plastic hinge 232 that is an integral part of sheet 234 from rear side 236 of sheet 234, and mates at front, left hand and right hand side edges 238, 240 and 242 along a U-shaped closure interface such as may be held closed by a closure member in the nature of a seal, a zipper, a hook and eye fabric fastener, or a similar device. It is not necessary that the opening of the container, or the liner, form a parallel plane to the respective base or bottom sides. The opening could be in a skewed plane, or could be something other than a plane.

Figure 11B:
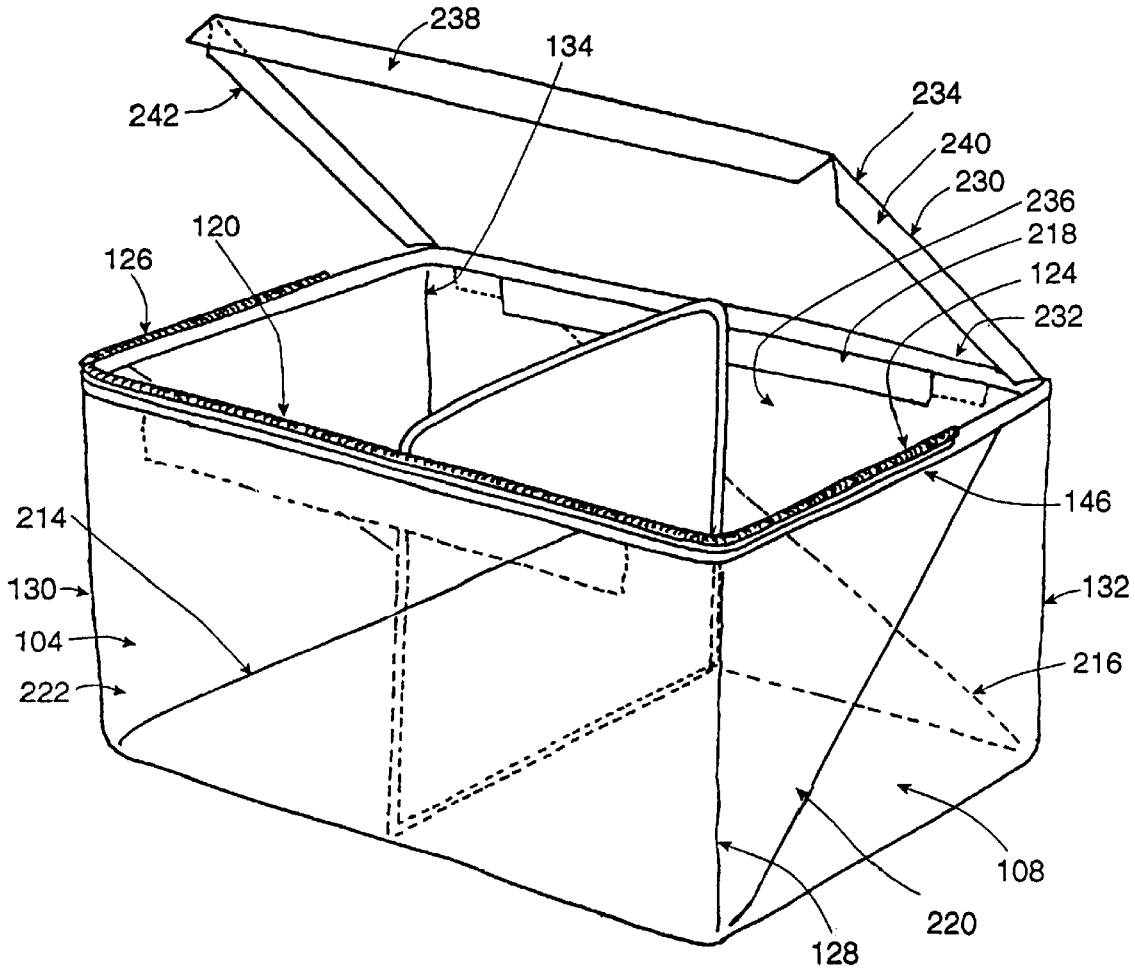
FIG. 11*b* is a further embodiment of the liner for the assembly of FIG. 1.

In alternative embodiments, one of each of corner flaps 220, 222, 224 and 226 can be folded against each of sides 104, 106, 108 and 110 as shown in FIG. 11*b*, or a pair (220, 224) can be folded against left hand side 108 and another pair (222, 226) against right hand side 110, rather than against front and rear sides 104 and 106 as illustrated in FIG. 11*a*. It is not necessary that the corner portions have one edge lying flush with lip 146. However, if the corner portions are cut down, the height at which a liquid tight barrier is provided may not necessarily be as high as shown in the preferred embodiment of FIG. 1. It is also not necessary that corner portions 192, 194, 196, and 198 be folded against the outside faces of the sides, but could be folded to lie along the inside faces. It would also be possible to fold each flap to lie partially against one side and partially against another side by using more than one fold line and by cutting the periphery of the corner portions differently. There is simplicity in using a single fold and to fold the flaps against the outside of one side of the liner, as shown in the preferred embodiment of FIG. 1.

Figure 4:
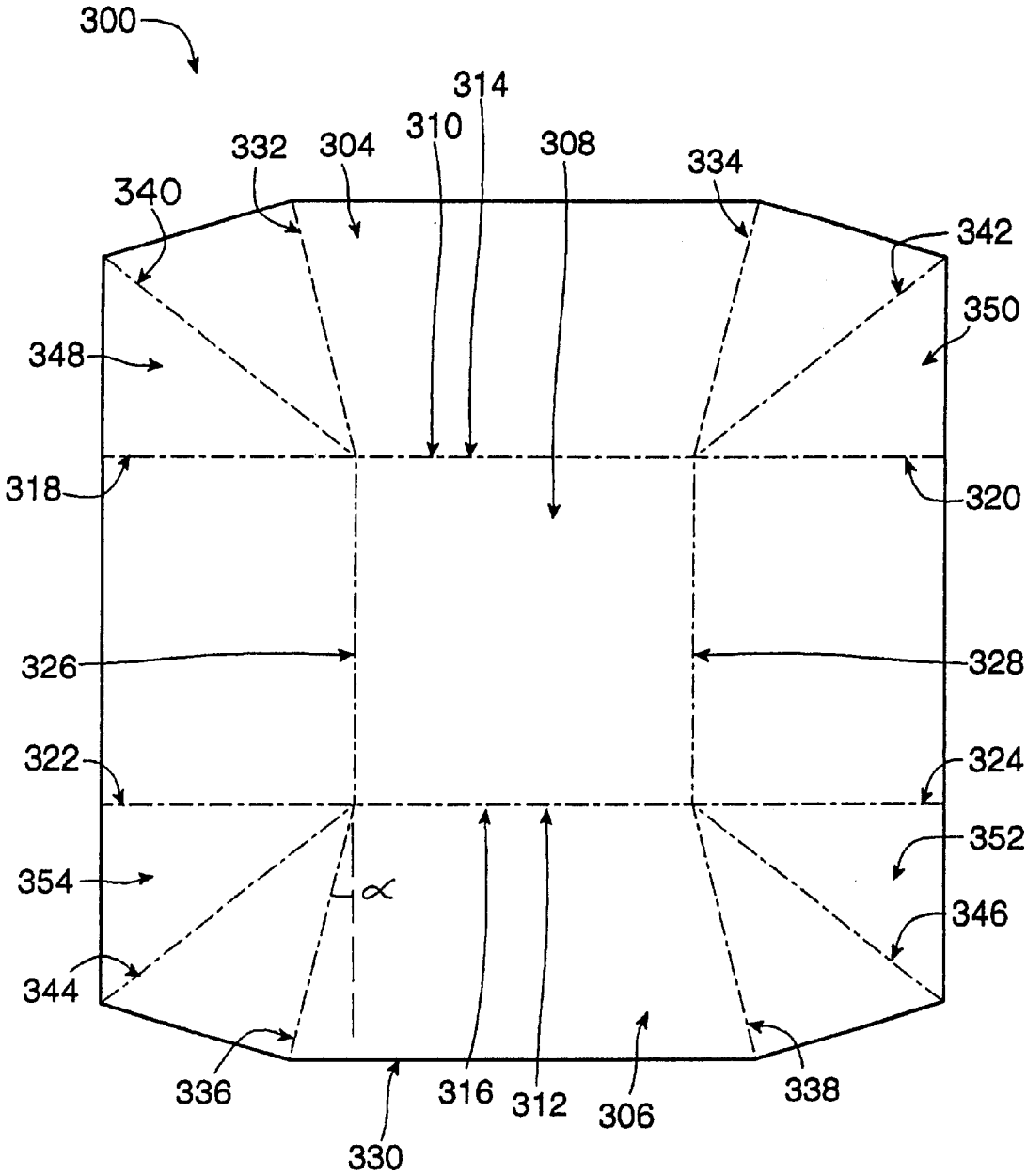
FIG. 4 is a developed view of an alternative liner for an assembly analogous to the liner of assembly of FIG. 1 in which two sides are tapered.
Figure 5:
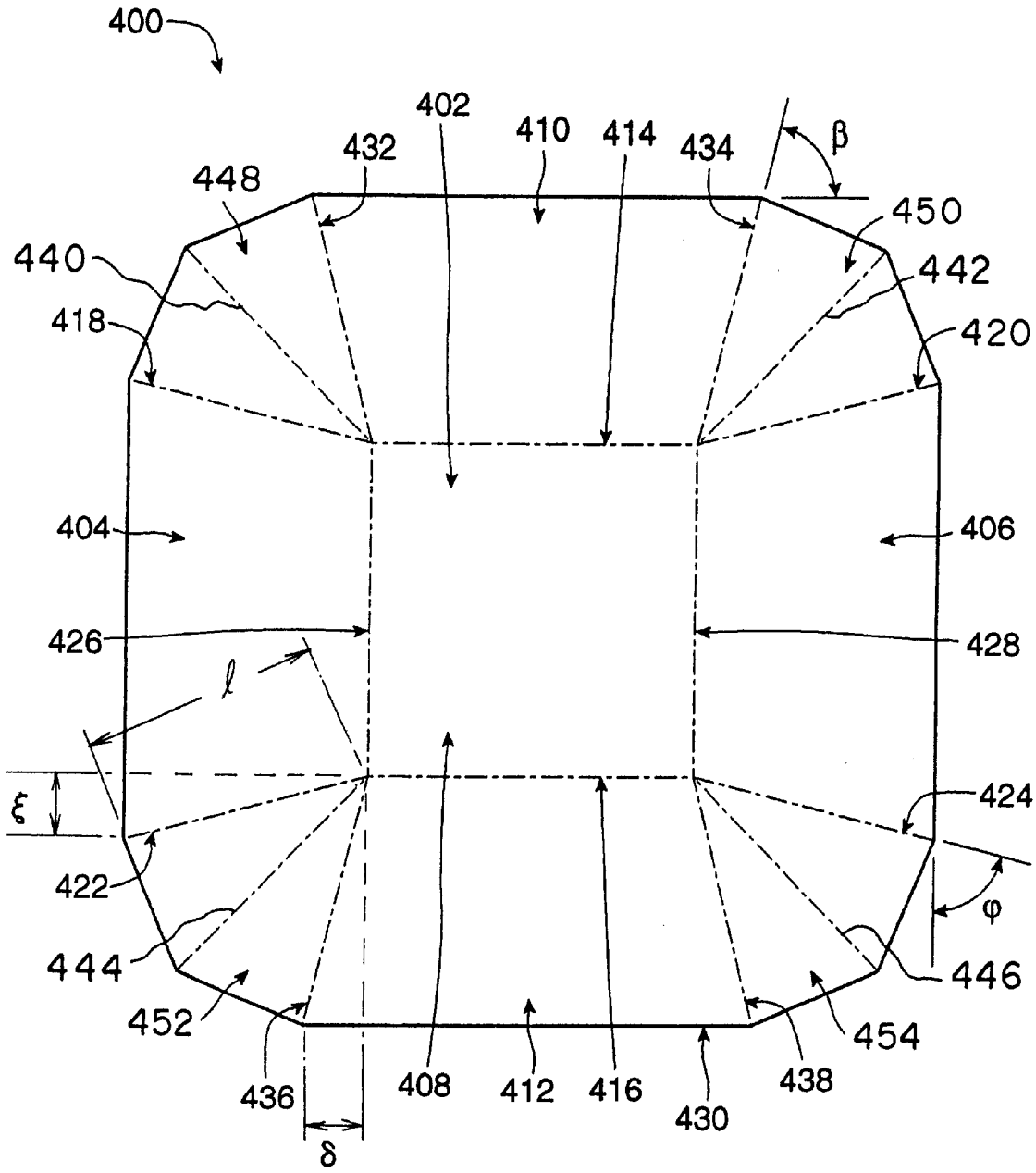
FIG. 5 is a developed view of an alternative liner for an assembly analogous to the liner of assembly of FIG. 1 in which four sides are tapered.
Figure 6:
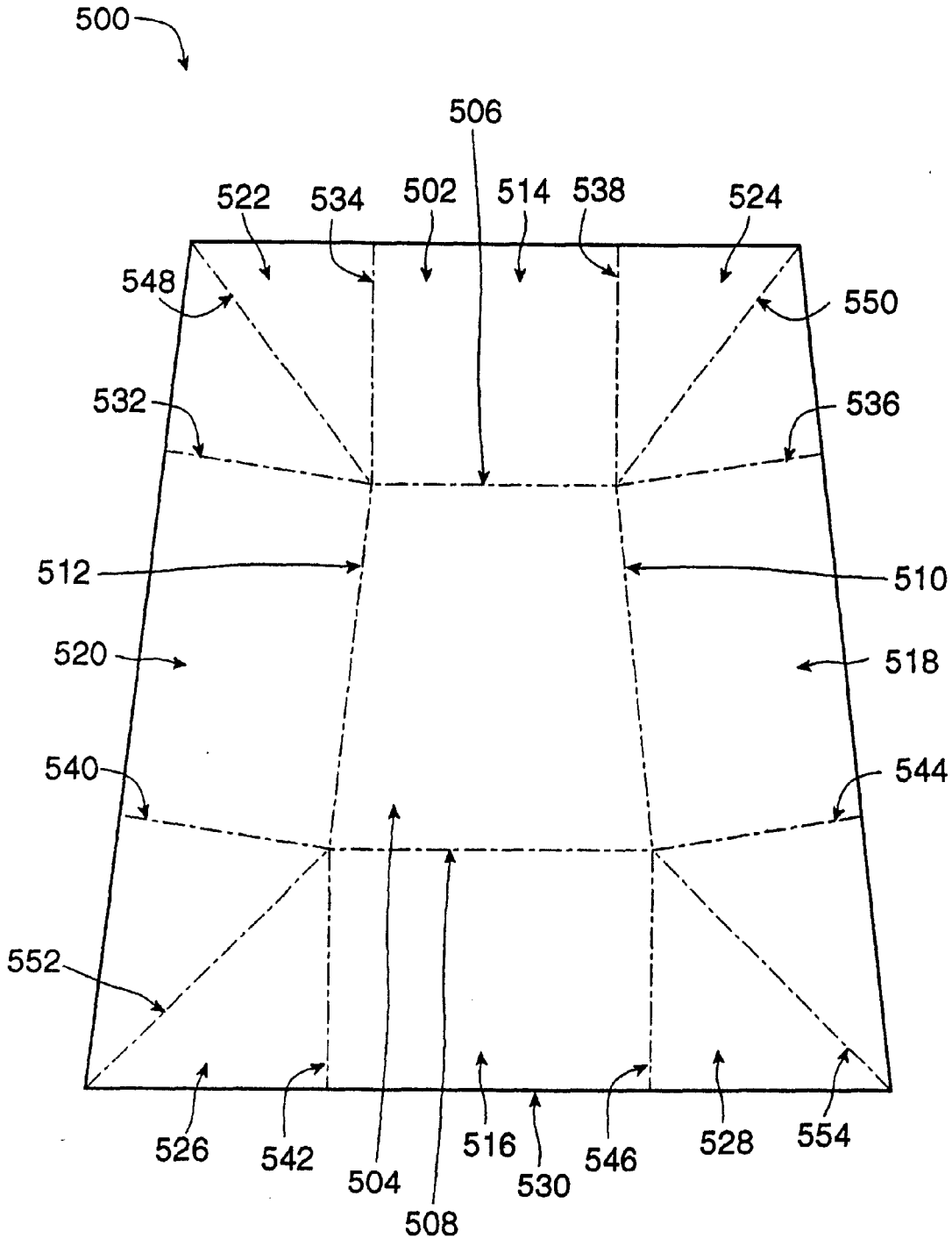
FIG. 6 is a developed view of an alternative liner for an assembly analogous to the liner of assembly of FIG. 1 in which the forward side of the assembly is wider than the rearward side.

As shown in the developed views of the alternate embodiments of FIGS. 4, 5, and 6, the liner need not be a cube or cuboid, but could be a tapered, trapezoidal, or truncated pyramidal shape. In the embodiment of FIG. 4 a developed sheet 300 has fold lines for forming a liner having a pair of opposed trapezoidal sides 304 and 306 which rise at right angles from a base 308, and a pair of opposed rectangular sides that are folded upward at an angle corresponding to the rake angle a of trapezoidal sides 304 and 306. It can be seen that there is one pair of parallel fold lines 310 and 312, each line having a central sector 314, 316 and a pair of left and right end sectors 318, 320 or 322, 324. There is also a pair of fold line sectors 326 and 328 which define the remaining two sides of base 308 (perpendicular to sectors 314 and 316). The intersections of sectors 326, 314, 328, and 316 define the corner of base 308. Extending away from those corner to periphery 330 are left and right hand canted trapezoidal side sectors 332, 334, 336, and 338 to define the remaining vertices of trapezoidal sides 304 and 306. At the angular bisector of the included angle between adjacent pairs of rectangular side lateral sectors and trapezoidal side sectors, as, for example between sectors 318 and 332, are corner portion fold lines 340, 342, 344, and 346. Corner portions 348, 350, 352 and 354, each defined between one trapezoidal side end sector, one rectangular side end sector and periphery 330, have been trimmed along periphery 330 to lie flush with the resulting lip. When sheet 300 is folded in a manner analogous to the folding of sheet 100, a cradle shaped liner will result, for mating use with a similarly cradle shaped container analogous to container 22.

In the embodiment of FIG. 5 a developed sheet 400 has fold lines for forming a liner 402 having a first pair of opposed trapezoidal sides 404 and 406 which rise at a non-perpendicular angle $\phi$ from a base 408, and a second pair of opposed trapezoidal sides 410, 412 that are folded upward at an angle corresponding to the vertical projection of the rake angle $\beta$ of the first pair of trapezoidal sides 404 and 406. It can be seen that there is one pair of fold line sectors 414, 416 and a perpendicular pair of fold line sectors 426 and 428 which define the remaining two sides of base 408. The intersections of sectors 426, 414, 428, and 416 define the corner of base 408. Extending away from those corner to periphery 430 are left and right hand trapezoidal side lateral sectors 418, 420, 422 and 424. Similarly, left and right hand canted trapezoidal side sectors 432, 434, 436, and 438 extend from those intersections toward periphery 430 to define the remaining vertices of the trapezoidal sides. At the angular bisector of the included angle between adjacent pairs of rectangular side lateral sectors and trapezoidal side sectors, as, for example between sectors 418 and 432, are corner portion fold lines 440, 442, 444, and 446 of corner portions 448, 450, 452 and 454.

Sectors 418, 420, 422, 424, 432, 434, 436 and 438 all have the same true length, indicated as I. The distance that sectors 418, 420, 422 and 424 are splayed outward from square is indicated as $\epsilon$. Similarly, the distance that sections 432, 434, 436 and 438 are splayed outward from square is indicated as $\delta$. Angle ($\phi$ satisfies the condition that $\text{Sin}\ \phi=(\epsilon/(I^2-\delta^2))^{1/2}$. Similarly Angle $\beta$ satisfies the condition that $\text{Sin}\ \beta=(\delta(I^2-\delta^2))^{1/2}$.

When folded in a manner analogous to the folding of sheet 100, sheet 400 will form a truncated, inverted rectangular shaped pyramid. It should be noted that the pairs of opposed slanted pyramid sides need not rise at the same angle, but could be at different angles. In the most general case, each side could rise at a different angle, and to a different height. The upper edges of the sides need not be level, but could have a slant, or, alternatively, need not be linear but could be curved as may suit the desired geometry. However, it is expected that the sides will, most often, have straight and level edges.

In the embodiment of FIG. 6, a developed sheet 500 has fold lines for forming a liner 502 having a trapezoidal base 504 such as might be desired in a knapsack having a large rearward face for placement against a person's back, and a narrower outer or forward face. A pair of parallel lines of unequal length, being a short front fold line 506 and a longer rear fold line 508, define the parallel sides of the trapezoidal base 504. A pair of left and right hand side fold lines 510 and 512 extend between lines 506 and 508 at angles to define the splayed sides of trapezoidal base 504. Front side 514, rear side 516, left side 518 and right side 520 are all hinged along respective fold lines 506, 508, 510 and 512 to base 504. Corner portions 522, 524, 526 and 528 are defined between the periphery 530 and respective pairs of side sectors 532 and 534, 536 and 538, 540 and 542, and 544 and 546. Each of portions 522, 524, 526 and 528 has a fold line 548, 550, 552 or 554 on which the respective corner portion is folded, those portions being trimmed along their peripheral edges to lie flush with the peripheral edges of the respective sides against which they are folded, similar to the manner described above in connection with the preferred embodiment.

A preferred embodiment has been described in detail and a number of alternatives have been considered. As changes in or additions to the above described embodiments may be made without departing from the nature, spirit or scope of the invention, the invention is not to be limited by or to those details, but only by the appended claims.

What is claimed is:

1. A combination comprising:

a soft-sided insulated container, and a removable liner for placement inside said container;

said container having a closure member;

said liner fitting filly within said container;

said closure member being operable to close said container with said liner fully contained therein;

said liner being washable and re-useable after having been washed;

said liner being folded from a monolithic sheet of liner stock to define a chamber, said liner being capable of holding liquids;

said liner being fixed to prevent said liner from becoming unfolded; and said liner being free of heat welded seams.

2. The combination of claim 1 wherein said liner is made from a water impermeable plastic sheet.

3. The combination of claim 1 wherein said liner is made from a translucent static cling vinyl sheet.

4. The combination of claim 1 wherein said soft sided insulated container has a base, sides and a top, said liner has a base, sides for placement inside and adjacent to said base and sides of said container; and said top of said container is moveable to an open position to permit articles to be placed in said chamber.

5. The combination of claim 4 wherein said chamber has an opening, said opening having a lip, and said liner is mated to said container about said lip.

6. The combination of claim 5 wherein said opening has four sides, said lip extends about said four sides of said opening; and said liner is mated to said container on said four sides.

7. The combination of claim 1 wherein said liner has a rectangular base and four sides extending from said base, each of said sides having an edge adjoining said base and a distal edge distant from said base; and said chamber has an opening defined between said distal edges of said sides.

8. The combination of claim 7 wherein one of said sides has a lid member extending therefrom, said lid member being moveable to close said opening of said liner.

9. The combination of claim 1 wherein said corner portions are folded to lie outwardly of said chamber.

10. A combination comprising:

a soft sided insulated container; and a washable, removable liner for placement fully inside said container, said liner being formed from a water impermeable plastic sheet, said sheet having a periphery;

said liner having a quadrilateral base and four sides extending from said base to define a chamber therebetween capable of holding water;

each of said sides being joined to said base at a base edge;

each of said sides having a pair of lateral edges each meeting said base edge at a corner;

each of said sides having an edge opposed to said base edge, said edge opposed to said base edge meeting each of said pair of lateral edges at a corner;

said sheet having corner portions defined between
(a) adjacent lateral edges of two of said sides, and
(b) said periphery; and said corner portions being folded to lie against said sides; and said corner portions being permanently fixedly secured to prevent said corner portions from unfolding.

11. The combination of claim 10 wherein:

each of said base and said sides has an interior face and an exterior face, the interior faces of said base and said sides co-operating to bound said chamber; and each of said corner portions is folded to lie against one of said exterior faces.

12. A combination comprising:

a soft sided insulated container, and a washable removable liner for placement fully inside said container, said liner being formed from a water impermeable plastic sheet; said sheet having a periphery;

said liner having a rectangular base and four sides extending from said base to form a chamber therebetween, each of said sides being joined to said base at a base edge;

said sheet being folded on a first pair of parallel fold lines to define one pair of said base edges;

said sheet being folded on a second pair of fold lines to define the remainder of said edges;

said sheet having four corner portions each defined between
(a) an end portion of one of said first pair of fold lines;
(b) an adjacent end portion of one of said second pair of fold lines, and
(c) said periphery;

said corner portions being folded to lie against said sides;

said corner portions being permanently fixedly held in position against said sides.

13. The combination of claim 12 wherein said sides have an inside face and an outside face and said corner portions are folded to lie against said outside faces.

14. The combination of claim 12 wherein each of said corners is folded to form a triangular flap, and each of said flaps is folded to lie against one of said sides.

15. The combination of claim 14 wherein two of said triangular flaps are folded to lie against one side of said liner.

16. The combination of claim 14 wherein two of said triangular flaps are folded to lie against one side of said liner, and the other two triangular flaps are folded to lie against another side of said liner.

17. The combination of claim 12 wherein each of said sides has a distal edge opposed to its respective base edge;

said chamber has a lip defined by said distal edges; and said corner portions are fastened to said sides adjacent said lip.

18. The combination of claim 12 wherein each of said four sides has an outside face oriented away from said chamber, and each of said corner portions is folded to lie against one of said outside faces.

19. A combination comprising:

a soft-sided insulated container and a liner;

said liner being mounted fully within said container;

said liner being washable;

said liner having a base and sides folded from a monolithic sheet of liner stock to define a chamber, said liner being capable of holding liquids within said chamber;

said liner being fixedly secured to prevent said liner from becoming unfolded; and said liner being free of heat welded seams.

20. The combination of claim 19 wherein:

said container has four side walls and a bottom panel, said side walls extending upwardly from said bottom panel;

each of said side walls meets said bottom panel at a lower edge;

each of said side walls has an upper edge distant from said bottom panel, said upper edges of said sides co-operating to define a rim; and said liner is mounted to said container about said rim.

21. The combination of claim 19 wherein:

said liner has four said sides extending upwardly from said base;

each of said sides meets said base at a folded lower edge;

each of said sides has an upper, distal edge distant from said base, said upper edges of said sides co-operating to define a lip; and said lip is mounted to said container.

22. The combination of claim 19 wherein:

said liner has four, quadrilateral sides folded upwardly from said base; and said liner has four corner portions folded to form triangular flaps;

and said triangular flaps are folded to lie against said sides.

23. The combination of claim 22 wherein said triangular flaps are folded to lie outwardly of said chamber.

24. The combination of claim 19 wherein:

said liner is folded from a monolithic rectangular sheet of liner stock;

said liner has four, quadrilateral sides folded upwardly from said base;

said liner has four corner portions folded to form triangular flaps;

two of said triangular flaps are folded to lie against one of said sides; and two of said triangular flaps are folded to lie against another of said sides.

25. The combination of claim 19 wherein:

said liner is folded from a monolithic rectangular sheet of liner stock;

said liner has four rectangular sides folded upwardly from said base;

said sides each have a lower edge meeting said base at a fold;

said sides each have an upper, distal edge distant from said lower edge;

said liner has four corner portions folded to form triangular flaps;

said triangular flaps are folded to lie against said sides; and one of said flaps has a lower corner adjacent to said base and an upper margin located next to an upper edge of one of said sides.

26. The combination of claim 19 wherein:

said liner is folded from a monolithic rectangular sheet of liner stock;

said liner has four rectangular sides folded upwardly from said base;

said sides each have a lower edge meeting said base at a fold;

said sides each have an upper, distal edge distant from said lower edge;

said liner has four corner portions folded to form first, second third and fourth triangular flaps;

said first and second triangular flaps are folded to lie against a first of said sides;

said third and fourth triangular flaps are folded to lie against a second of said sides; and each of said flaps has a lower corner adjacent to said base, and an upper margin;

the upper margins of said first and second flaps lying adjacent to the upper edge of the first of said sides; and the upper margins of said third and fourth flaps lying adjacent to the upper edge of the second of said sides.

27. The combination of claim 19 wherein said container is collapsible.

28. The combination of claim 27 wherein said container is moveable to a storage position and said container has fasteners for retaining said container in said storage position.

29. The combination of claim 19 wherein:

said liner has four, quadrilateral sides folded upwardly from said base, each of said sides having an interior face and an exterior face;

said liner has four corner portions folded to form triangular flaps; and said triangular flaps are folded to lie against said exterior faces of said sides.

30. A combination comprising:

a soft-sided insulated container, and a washable liner;

said liner being mounted fully within said container;

said liner being folded from a monolithic sheet of liner stock and having a quadrilateral base and four sides extending upwardly from said base to define a chamber;

each of said sides adjoining said base at a folded edge;

each of said sides having a distal edge distant from said base;

at least of one said distal edges being at a first height relative to said base;

said sides being permanently secured to prevent said liner from unfolding;

said liner being capable of holding liquids up to a second height relative to said base;

said second height being at least one half of said first height; and said liner being seamless from said base up to at least said second height.

31. The combination of claim 30 wherein said liner is free of heat welded seams up to said second height.

32. The combination of claim 30 wherein said liner is free of punctures up to said second height.

33. The combination of claim 30 wherein said second height is not greater than three quarters of said first height.

34. The combination of claim 30 wherein said chamber has a lip defined by said distal edges and said liner has stitching adjacent said lip.

35. The combination of claim 30 wherein:

said container has a bottom panel and four side panels extending upwardly from said bottom panel;

each of said side panels has a lower edge adjoining said bottom panel and a distal edge distant from said bottom panel;

said distal edges of said container sides co-operate to define a rim; and said liner is mounted to said container at said rim.

36. The combination of claim 35 wherein said liner is releasably attached to said rim.

37. The combination of claim 35 wherein said container sides extend to a third height relative to said container base and said third height is equal to said first height.

38. The combination of claim 30 wherein said container is collapsible.

39. The combination of claim 38 wherein said container is collapsible to a storage position and said container has fasteners for retaining said container in said storage position.

40. The combination of claim 30 wherein said sheet is a vinyl sheet.

41. The combination of claim 40 wherein said sheet is translucent.

42. The combination of claim 30 wherein:

each of said sides has a pair of lateral edges each extending between the folded edges and the distal edges of said sides; and said sheet has a periphery and corner portions defined between (a) adjacent lateral edges of two of said sides, and (b) said periphery;

said corner portions are folded to lie against said sides; and said corner portions are permanently secured to discourage said liner from unfolding.

43. The combination of claim 30 herein said sheet is folded on a first pair of parallel fold lines to define one pair of said folded edges;

said sheet is folded on a second pair of fold lines to define the remainder of said edges;

said sheet has a periphery;

said first pair of fold lines intersect said second pair of fold lines at four points of intersection defining corners of said base;

said first pair of fold lines have end portions lying between respective ones of said second pair of fold lines and said periphery, and middle portions lying between said second pair of fold lines;

said second pair of fold lines have end portions lying between respective ones of said first pair of fold lines and said periphery, and middle portions lying between said first pair of fold lines;

said sheet has four corner portions, each corner portion being defined between (a) an end portion of one of said first pair of fold lines;

(b) an adjacent end portion of one of said second pair of fold lines, and (c) said periphery;

said corner portions being folded to lie against said sides, and said corner portions are permanently secured to discourage said liner from unfolding.

44. The combination of claim 43 wherein each of said corner portions is folded to form a flap and each of said flaps is folded to lie against one of said sides.

45. The combination of claim 43 wherein said corner portions are folded to form triangular flaps.

46. The combination of claim 30 wherein:

said container has four side walls and a bottom panel, said side walls extending upwardly from said bottom panel;

each of said side walls meets said bottom panel at a lower edge;

each of said side walls has an upper edge distant from said bottom panel, said upper edges of said sides co-operating to define a rim; and said liner is mounted to said container about said rim.

47. The combination of claim 30 wherein:

said liner has four said sides extending upwardly from said base;

each of said sides meets said base at a folded lower edge;

each of said sides has an upper, distal edge distant from said base, said upper edges of said sides co-operating to define a lip; and said lip is mounted to said container.

48. The combination of claim 30 wherein:

said liner has four, quadrilateral sides folded upwardly from said base; and said liner has four corner portions folded to form triangular flaps;

said triangular flaps are folded to lie against said sides; and said flaps are permanently secured in position against said sides to prevent said liner from unfolding.

49. The combination of claim 30 wherein:

said liner is folded from a monolithic rectangular sheet of liner stock;

said liner has four, quadrilateral sides folded upwardly from said base; and said liner has four corner portions folded to form triangular flaps;

two of said triangular flaps are folded to lie against one of said sides;

two of said triangular flaps are folded to lie against another of said sides; and said flaps are permanently secured to said sides to prevent said liner from unfolding.

50. The combination of claim 30 wherein:

said liner is folded from a monolithic rectangular sheet of liner stock;

said liner has four rectangular sides folded upwardly from said base;

said sides each have a lower edge meeting said base at a fold;

said sides each have an upper, distal edge distant from said lower edge;

said liner has four corner portions folded to form triangular flaps;

said triangular flaps are folded to lie against said sides; and one of said flaps has a lower corner adjacent to said base and an upper margin located next to an upper edge of one of said sides, said upper margin being permanently secured to prevent said flap from unfolding.

51. The combination of claim 30 wherein:

said liner is folded from a monolithic rectangular sheet of liner stock; said liner has four rectangular sides folded upwardly from said base;

said sides each have a lower edge meeting said base at a fold;

said sides each have an upper, distal edge distant from said lower edge;

said liner has four corner portions folded to form first, second third and fourth triangular flaps;

said first and second triangular flaps are folded to lie against a first of said sides;

said third and fourth triangular flaps are folded to lie against a second of said sides; and each of said flaps has a lower corner adjacent to said base, and an upper margin;

the upper margins of said first and second flaps lying adjacent to the upper edge of the first of said sides;

the upper margins of said third and fourth flaps lying adjacent to the upper edge of the second of said sides; and said upper margins of said flaps are permanently secured to prevent said flaps from unfolding.

52. The combination of claim 51 wherein said chamber has a lip defined by said distal edges; and said flaps are secured to said sides adjacent said lip.

53. The combination of claim 30 wherein:

each of said four sides has an interior face and an exterior face;

said liner has four folded corner portions; and said corner portions each lie against one of said exterior faces of said sides.

54. The combination of claim 30 wherein:

said liner has four corner portions folded to form triangular flaps; and said triangular flaps are folded to lie outwardly of said chamber.

* * * * *